US011489289B2

(12) United States Patent
Liu et al.

(10) Patent No.: US 11,489,289 B2
(45) Date of Patent: Nov. 1, 2022

(54) ELECTRICAL CONNECTOR HAVING STACKED MODULE SHEETS EACH WITH A CONDUCTIVE SHELL AND A SHEET-SHAPED GROUND PLATE TOGETHER ENCLOSING SIGNAL TERMINALS DISCRETELY SUPPORTED BY INSULATING MEMBERS

(71) Applicants: FU DING PRECISION INDUSTRIAL (ZHENGZHOU) CO.,LTD., Zhengzhou (CN); FOXCONN INTERCONNECT TECHNOLOGY LIMITED, Grand Cayman (KY)

(72) Inventors: Meng Liu, Kunshan (CN); Shih-Wei Hsiao, New Taipei (TW); Yu-San Hsiao, New Taipei (TW); Yen-Chih Chang, New Taipei (TW); Jhih-Yao Jiang, New Taipei (TW); Yu-Ke Chen, Kunshan (CN)

(73) Assignees: FUDING PRECISION INDUSTRY (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/137,401

(22) Filed: Dec. 30, 2020

(65) Prior Publication Data

US 2021/0203107 A1 Jul. 1, 2021

(30) Foreign Application Priority Data

Dec. 31, 2019 (CN) ..... 201911411585.5

(51) Int. Cl.
*H01R 13/6471* (2011.01)
*H01R 12/73* (2011.01)
(Continued)

(52) U.S. Cl.
CPC ..... *H01R 13/6471* (2013.01); *H01R 12/55* (2013.01); *H01R 12/716* (2013.01); *H01R 12/73* (2013.01); *H01R 13/6587* (2013.01)

(58) Field of Classification Search
CPC ..... H01R 13/6473; H01R 13/6588; H01R 13/6476; H01R 13/6477; H01R 13/6587;
(Continued)

(56) References Cited

U.S. PATENT DOCUMENTS 5,980,321 A 11/1999 Cohen et al.
6,146,202 A * 11/2000 Ramey ..... H01R 43/205 439/607.1
(Continued)

FOREIGN PATENT DOCUMENTS

CN 2519481 Y 10/2002
CN 1398446 A 2/2003
(Continued)

*Primary Examiner* — Marcus E Harcum
(74) *Attorney, Agent, or Firm* — Ming Chieh Chang

(57) ABSTRACT

An electrical connector includes: a housing; plural terminals held on the housing, the terminals being arranged in the form of terminal pairs for transmitting differential signals; plural first shielding sheets shielding the terminals; and plural second shielding sheets shielding the terminals, the second shielding sheet being arranged to cross the first shielding sheets to form plural shielding cavities separated from each other, the terminal pairs being distributed in corresponding shielding cavities, wherein one first shielding sheet is provided between each terminal pair and an laterally adjacent
(Continued)

terminal pair and two second shielding sheets are provided between each terminal pair and a longitudinally adjacent terminal pair.

18 Claims, 20 Drawing Sheets

(51) Int. Cl.
*H01R 13/6587* (2011.01)
*H01R 12/55* (2011.01)
*H01R 12/71* (2011.01)

(58) Field of Classification Search
CPC ..... H01R 13/6585; H01R 13/6586; H01R 13/6471; H01R 13/6594; H01R 12/55; H01R 12/73; H01R 12/716; H01R 12/722; H01R 12/727; H01R 12/737
USPC ..... 439/95, 108, 607.05–607.1, 931
See application file for complete search history.

(56) References Cited

U.S. PATENT DOCUMENTS 6,663,429 B1 12/2003 Hon Hai
6,743,057 B2 * 6/2004 Davis ..... H01R 13/6586 439/607.05
6,899,566 B2 5/2005 Kline et al.
6,971,916 B2 * 12/2005 Tokunaga ..... H01R 13/6583 439/607.05
6,988,902 B2 1/2006 Winings et al.
7,094,102 B2 * 8/2006 Cohen ..... H05K 7/1445 439/607.08
7,422,484 B2 * 9/2008 Cohen ..... H05K 1/14 439/607.05
7,553,187 B2 * 6/2009 Feldman ..... H01R 13/506 439/607.17
7,588,463 B2 * 9/2009 Yamada ..... H01R 43/20 439/607.05
7,682,193 B2 * 3/2010 Stoner ..... H01R 13/6585 439/607.07
7,758,357 B2 * 7/2010 Pan ..... H01R 13/506 439/701
7,785,148 B2 8/2010 Pan
7,862,376 B2 * 1/2011 Sypolt ..... H01R 12/585 439/607.07
7,980,895 B2 * 7/2011 Berens ..... H01R 43/24 439/607.05
8,011,957 B2 * 9/2011 Pan ..... H01R 13/514 439/607.1
8,167,651 B2 * 5/2012 Glover ..... H01R 12/585 439/607.08
8,202,118 B2 6/2012 Cohen et al.
8,382,520 B2 * 2/2013 Ritter ..... H01R 13/6471 439/607.05
8,419,472 B1 * 4/2013 Swanger ..... H01R 13/6587 439/607.07
8,444,436 B1 * 5/2013 Cohen ..... H05K 1/115 439/607.08
8,465,302 B2 6/2013 Regnier et al.
8,469,745 B2 * 6/2013 Davis ..... H01R 12/737 439/607.07
8,475,209 B1 * 7/2013 Whiteman, Jr ..... H01R 12/724 439/607.07
8,529,300 B2 * 9/2013 Ritter ..... H01R 13/514 439/701
8,597,052 B2 * 12/2013 Davis ..... H01R 13/6596 439/607.08
8,662,924 B2 * 3/2014 Davis ..... H01R 13/6477 439/607.07
8,715,005 B2 5/2014 Pan
8,894,442 B2 * 11/2014 McClellan ..... H01R 13/6587 439/607.05
8,905,786 B2 12/2014 Davis et al.
8,920,195 B2 12/2014 Cohen et al.
8,961,227 B2 2/2015 Gailus et al.
8,961,229 B2 2/2015 Pan
8,992,252 B2 * 3/2015 McClellan ..... H01R 13/6587 439/607.05
9,077,094 B2 7/2015 Minich
9,166,343 B1 * 10/2015 Jeon ..... H01R 13/6587
9,240,638 B2 * 1/2016 Peloza ..... H01R 13/6473
9,240,657 B2 * 1/2016 Chang ..... H01R 13/6588
9,257,778 B2 * 2/2016 Buck ..... H01R 13/6587
9,356,401 B1 * 5/2016 Horning ..... H01R 13/6585
9,407,045 B2 8/2016 Horning et al.
9,608,380 B2 * 3/2017 Horning ..... H01R 13/6587
9,608,382 B2 * 3/2017 McClellan ..... H01R 13/6587
9,748,698 B1 8/2017 Morgan et al.
9,831,588 B2 11/2017 Cohen
9,831,608 B1 * 11/2017 Pickel ..... H01R 13/6473
10,038,282 B2 7/2018 De Geest et al.
10,170,869 B2 1/2019 Gailus et al.
10,205,286 B2 2/2019 Provencher et al.
10,355,416 B1 7/2019 Pickel et al.
10,644,453 B2 5/2020 Laurx et al.
10,686,282 B1 6/2020 McCarthy et al.
10,707,626 B2 7/2020 Cartier, Jr. et al.
10,826,245 B2 * 11/2020 Chen ..... H01R 13/518
2001/0012730 A1 8/2001 Ramey
2002/0086568 A1 7/2002 Figueroa
2003/0040202 A1 2/2003 Norris
2004/0171305 A1 9/2004 Mcgowan
2004/0201084 A1 * 10/2004 Nakada ..... H01R 13/41 257/678
2004/0259392 A1 12/2004 Wu
2005/0048838 A1 3/2005 Korsunsky
2009/0093115 A1 4/2009 Park
2009/0170373 A1 7/2009 Pan
2009/0203259 A1 8/2009 Nguyen
2010/0144204 A1 6/2010 Knaub
2011/0034081 A1 2/2011 Feldman
2011/0230096 A1 * 9/2011 Atkinson ..... H01R 13/6598 439/607.08
2012/0129395 A1 * 5/2012 Davis ..... H01R 12/737 439/660
2013/0017721 A1 * 1/2013 Mason ..... H01R 13/6585 439/607.08
2013/0189858 A1 * 7/2013 Johnescu ..... H01R 13/6471 439/95
2013/0210246 A1 * 8/2013 Davis ..... H01R 12/7082 439/607.05
2013/0337667 A1 12/2013 Szczesny et al.
2014/0024256 A1 * 1/2014 Davis ..... H01R 13/6587 439/607.05
2014/0148054 A1 * 5/2014 Annis ..... H01R 13/514 439/607.05
2014/0162471 A1 6/2014 Hon Hai
2014/0248796 A1 * 9/2014 Pan ..... H01R 13/6587 439/540.1
2014/0342607 A1 11/2014 Wang et al.
2016/0013594 A1 * 1/2016 Costello ..... H01R 13/6585 439/607.12
2016/0072231 A1 * 3/2016 Sypolt ..... H01R 13/6585 439/607.08
2016/0093985 A1 * 3/2016 Zhang ..... H01R 43/20 29/830

FOREIGN PATENT DOCUMENTS

CN 2562428 Y 7/2003
CN 101276966 U 10/2008
CN 101527409 A 9/2009
CN 101888032 A 11/2010
CN 101958473 A 1/2011
CN 201820905 U 5/2011
CN 202034538 11/2011
CN 202454772 9/2012
CN 102714378 A 10/2012
CN 103296510 A 9/2013
CN 103518293 A 1/2014

(56) References Cited

FOREIGN PATENT DOCUMENTS

| | | | |
|---|---|---|---|
| CN | 104022402 | A | 9/2014 |
| CN | 104022404 | A | 9/2014 |
| CN | 204668627 | | 9/2015 |
| CN | 105470679 | A | 4/2016 |
| CN | 105470732 | A | 4/2016 |
| CN | 102904119 | | 6/2016 |
| CN | 104167620 | | 8/2017 |
| CN | 107565279 | A | 1/2018 |
| CN | 206850102 | U | 1/2018 |
| CN | 104718666 | | 8/2018 |
| CN | 109494499 | | 3/2019 |
| CN | 109546386 | A | 3/2019 |
| CN | 109546458 | A | 3/2019 |
| CN | 105470736 | | 8/2019 |
| JP | 2009146769 | A | 7/2009 |
| TW | M366216 | U | 10/2009 |

* cited by examiner

ELECTRICAL CONNECTOR HAVING STACKED MODULE SHEETS EACH WITH A CONDUCTIVE SHELL AND A SHEET-SHAPED GROUND PLATE TOGETHER ENCLOSING SIGNAL TERMINALS DISCRETELY SUPPORTED BY INSULATING MEMBERS

BACKGROUND OF THE INVENTION

1. Field of the Invention

The present invention relates generally to an electrical connector, and more particularly to a high-speed backplane electrical connector used in communications field.

2. Description of Related Arts

U.S. Pat. No. 8,905,786 discloses a header electrical connector and receptacle electrical connector matched with the plug electrical connector, the header connector includes a housing holding a plurality of signal contacts and ground contacts shielding corresponding signal contacts.

U.S. Pat. No. 8,961,229 discloses a header electrical connector and a receptacle electrical connector. The receptacle electrical connector includes plural module sheets. Each module sheet includes a conductive shell defining plural slots therein, plural contact modules each received in one of the slots, a plurality of signal terminals which are accommodated in corresponding slots, and a plurality insulating members held on the of signal terminals and electrically isolating the signal terminal from the conductive shell. The insulating members on the signal terminal is continuously arranged on the signal transmission path of the signal terminal. This makes it not easy to adjust the impedance matching between the signal terminals.

Therefore, an improved electrical connector is needed, that can transmit differential signals transmission at 56 Gbps or higher and has simple structure.

SUMMARY OF THE INVENTION

A main object of the present invention is to provide an electrical connector with high transmission speed and simple and reliable structure.

To achieve the above-mentioned object, an electrical connector comprises: a housing; plural terminals held on the housing, the terminals being arranged in the form of terminal pairs for transmitting differential signals; plural first shielding sheets shielding the terminals; and plural second shielding sheets shielding the terminals, the second shielding sheet being arranged to cross the first shielding sheets to form plural shielding cavities separated from each other, the terminal pairs being distributed in corresponding shielding cavities, wherein one first shielding sheet is provided between each terminal pair and an laterally adjacent terminal pair and two second shielding sheets are provided between each terminal pair and a longitudinally adjacent terminal pair.

To achieve the above-mentioned object, a mating electrical connector for mounting on a circuit board and mating with the electrical connector comprises: a plurality of module sheets stacked laterally each including a conductive shell having a plurality of grooves on one side thereof and a plurality of ribs each formed between every two adjacent grooves, a plurality of signal terminals accommodated in corresponding grooves, a plurality of insulating members which are installed in the conductive shell for fixing corresponding signal terminals and electrically isolating the signal terminals from the conductive shell, and a sheet-shaped ground plate installed on the one side of the conductive shell; and a fixing member for securing the plurality of module sheets together; wherein the insulating members on at least one of the signal terminal are discretely arranged.

Compared to the prior art, in the electrical connector assembly of the present invention, the first shielding sheets and the second shielding sheets are arranged to cross each other to connected and form a plurality of shielding cavities; a terminal pair is shielded from four direction in a shielding cavities; a first shielding sheet is provided between a terminal pair and the terminal pair adjacent to it in the lateral direction; a pair of the second shielding sheet arranged at intervals is provided between a terminal pair and the terminal pair adjacent to the terminal pair in the longitudinal direction, improve the shielding effect of the electrical connector, and the structure is simple and reliable. The insulating members on the signal terminal is discretely arranged on the signal transmission path of the signal terminal to adjust the impedance matching between the signal terminals and provide better conditions for the stable transmission of high-speed signals.

DETAILED DESCRIPTION OF THE PREFERRED EMBODIMENT

Figure 1:
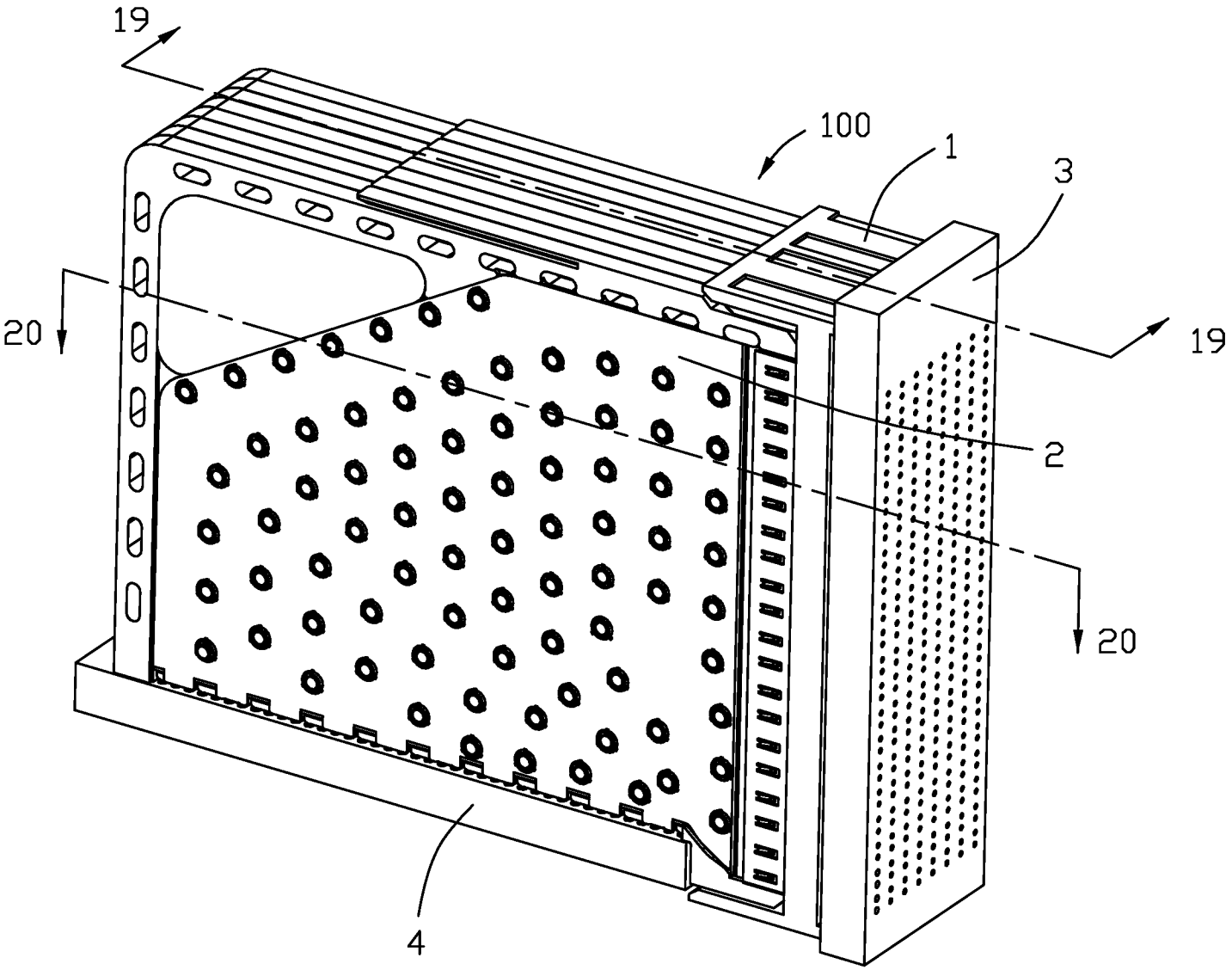
FIG. 1 is a perspective view of a connector assembly in accordance with the present invention.
Figure 2:
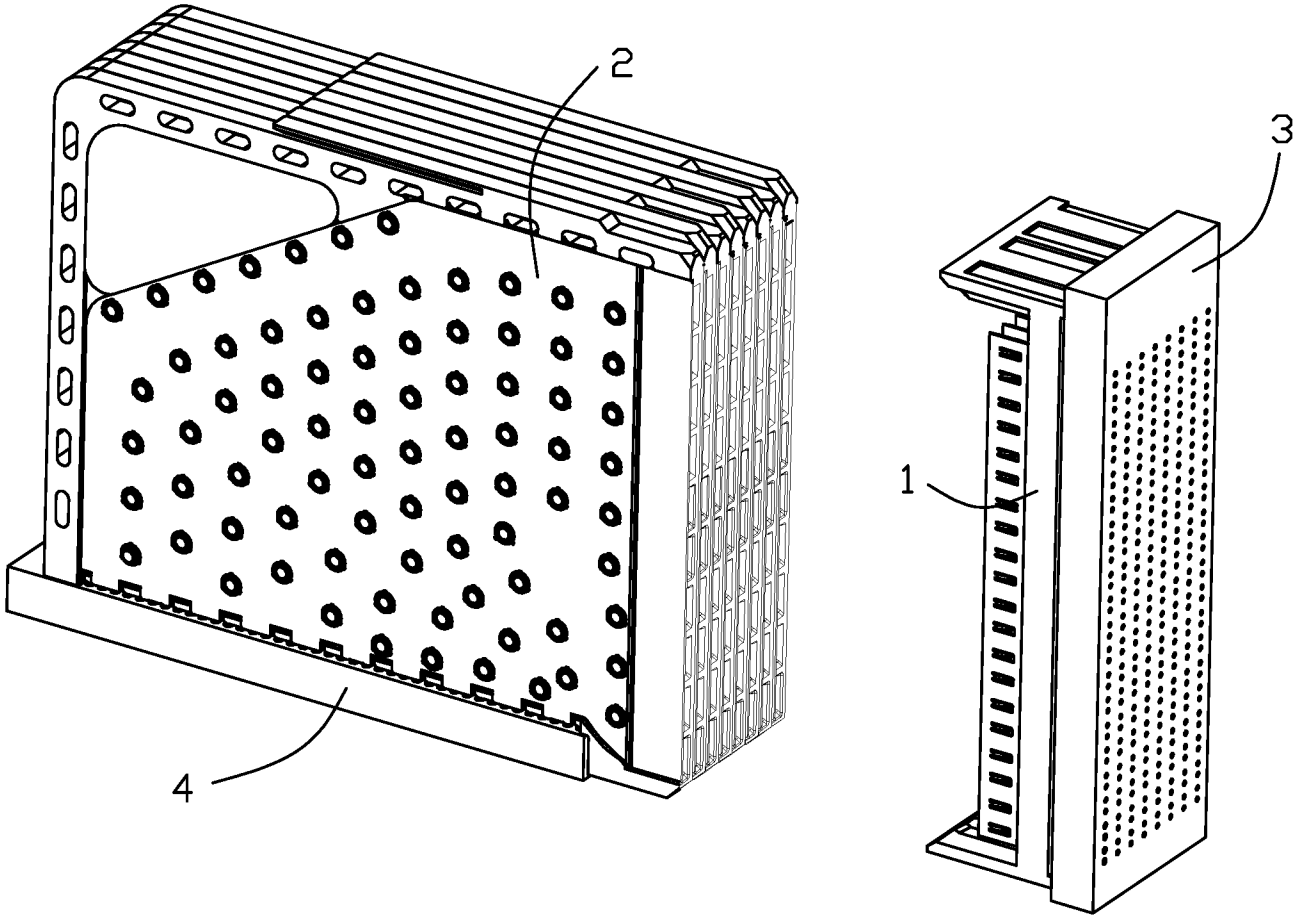
FIG. 2 is a perspective view of the first electrical connector and the second electrical connector of the connector assembly in a mated state in FIG. 1.
Figure 3:
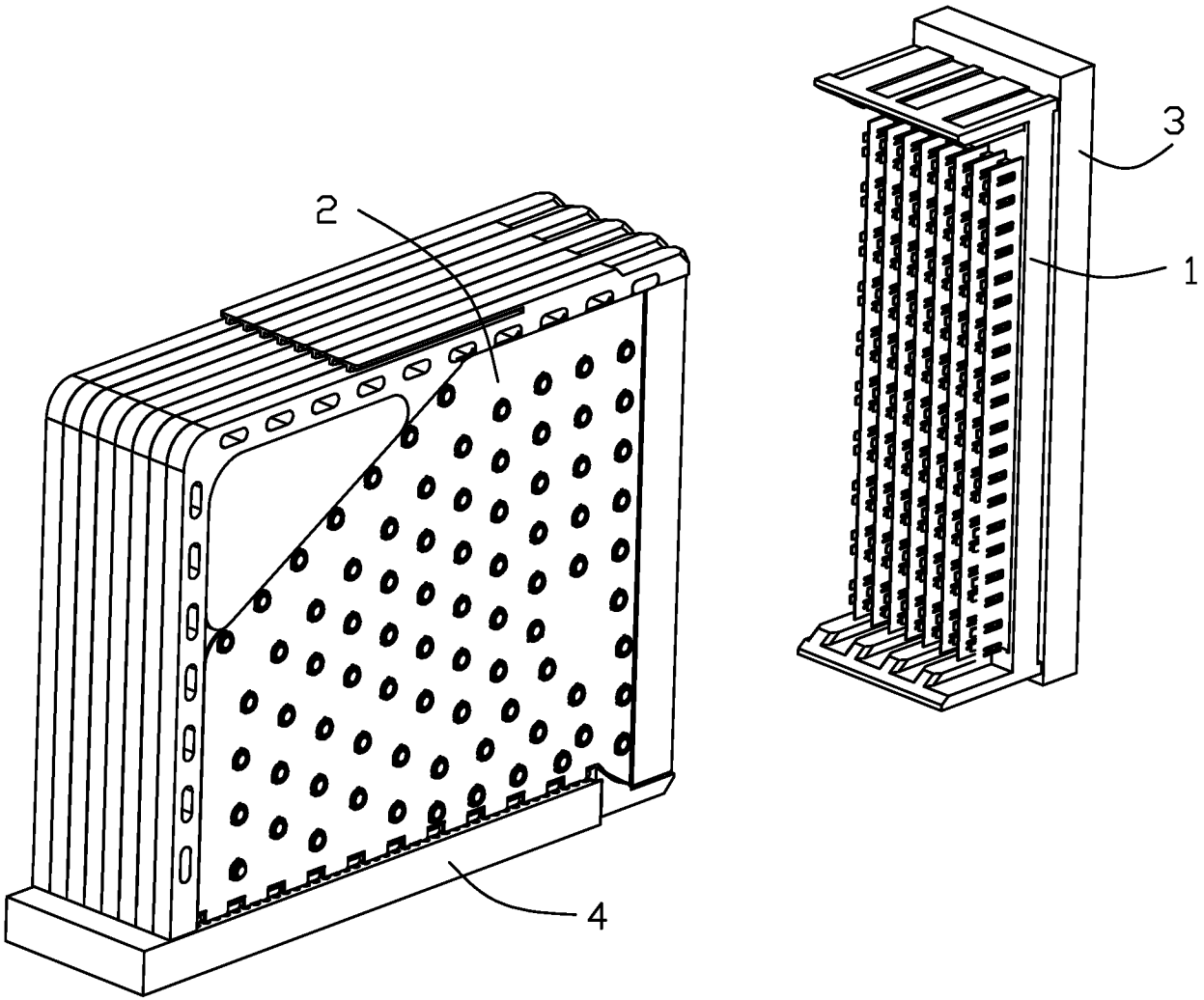
FIG. 3 is another perspective view of first electrical connector and the second electrical connector in a mated state in FIG. 2.
Figure 4:
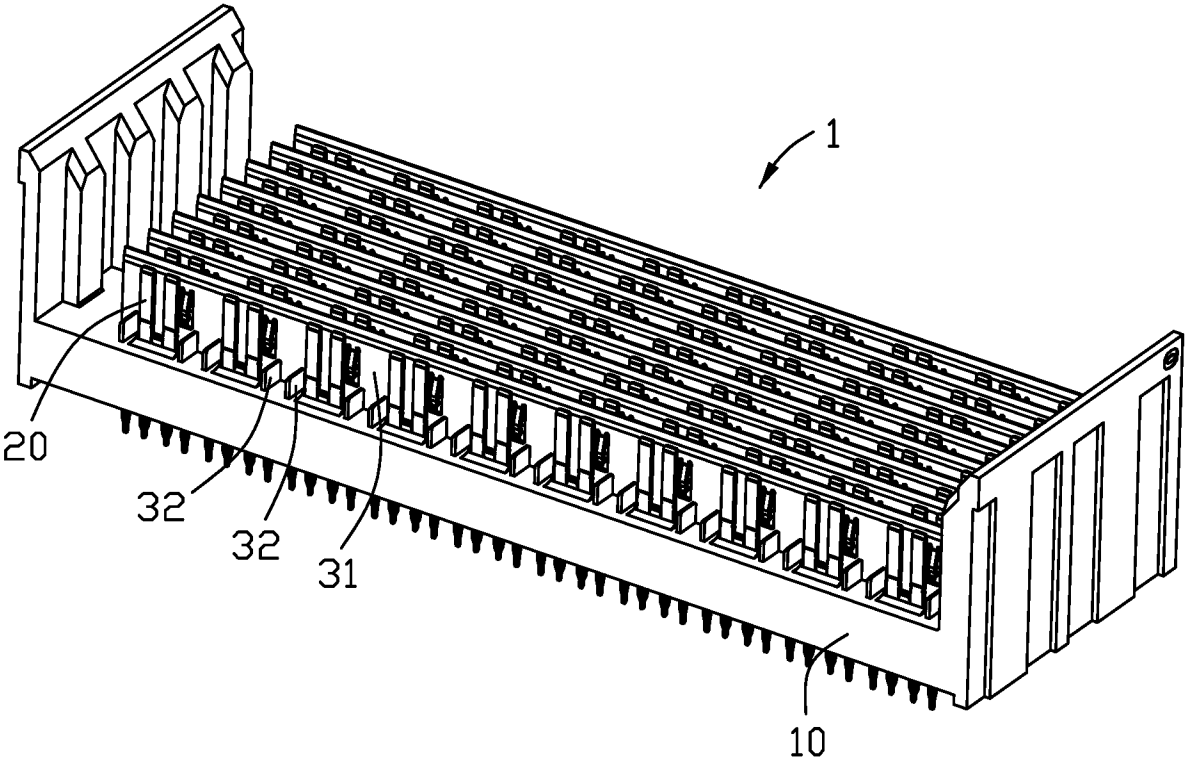
FIG. 4 is a perspective view of the first electrical connector in FIG. 1.
Figure 5:
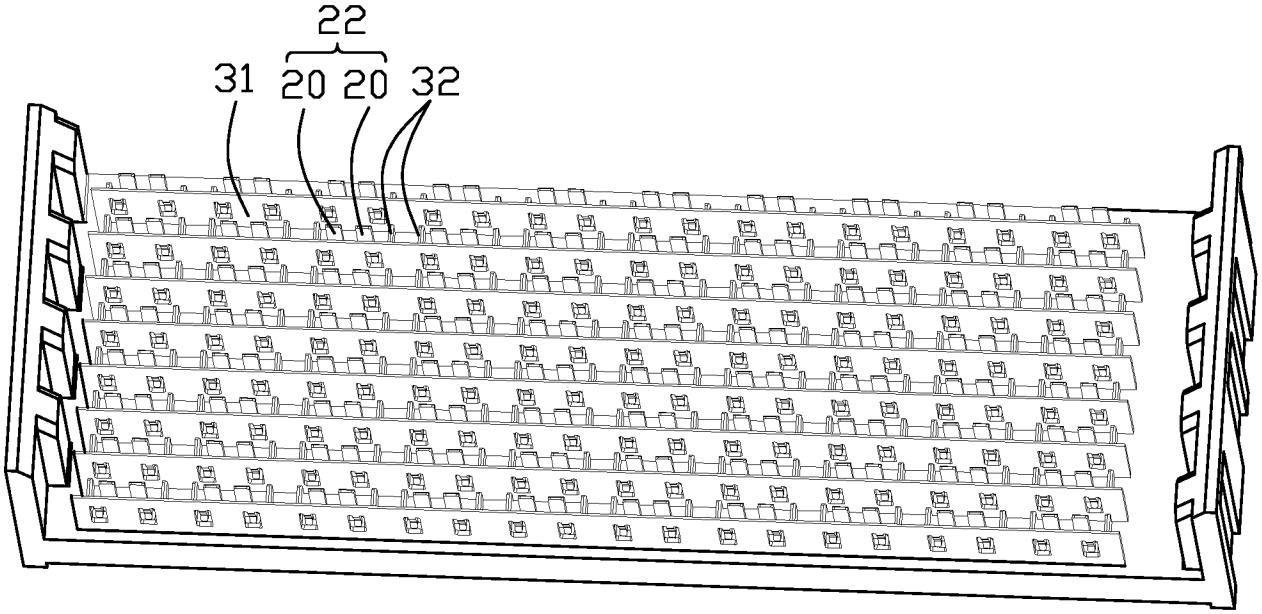
FIG. 5 is another perspective view of the first electrical connector in FIG. 4.
Figure 6:
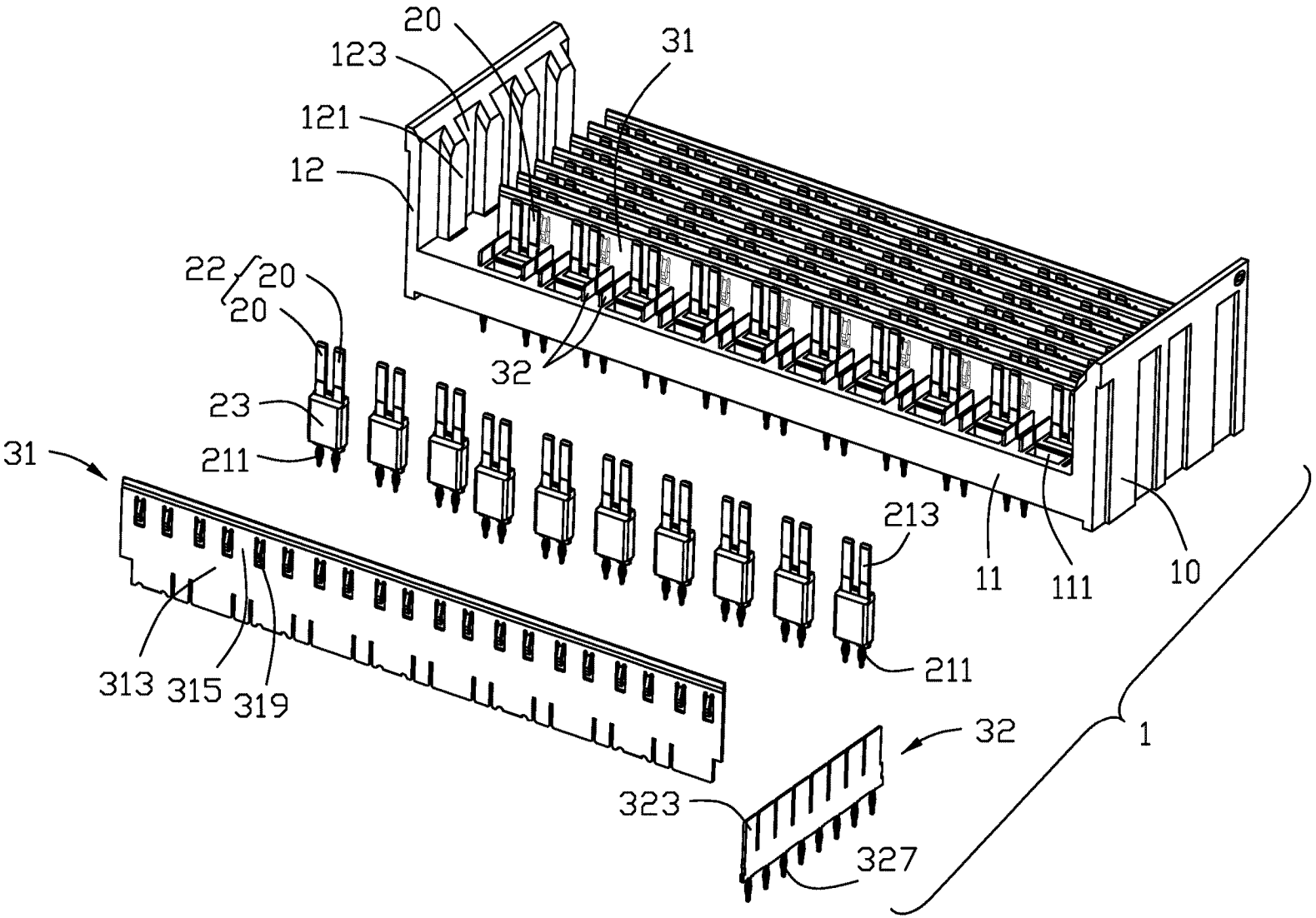
FIG. 6 is a partial exploded view of the first electrical connector in FIG. 4.
Figure 7:
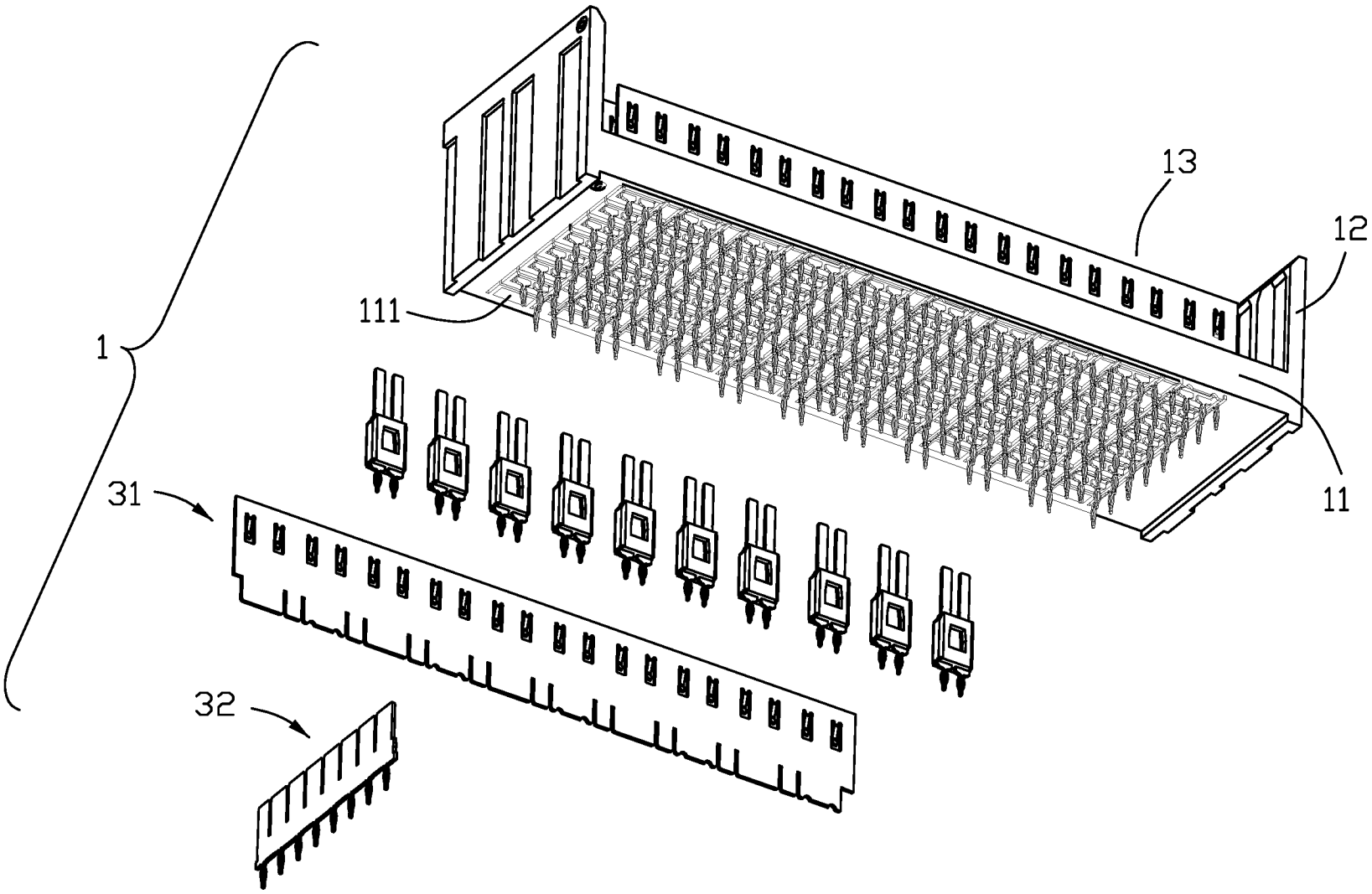
FIG. 7 is another partial exploded view of the first electrical connector in FIG. 6.
Figure 8:
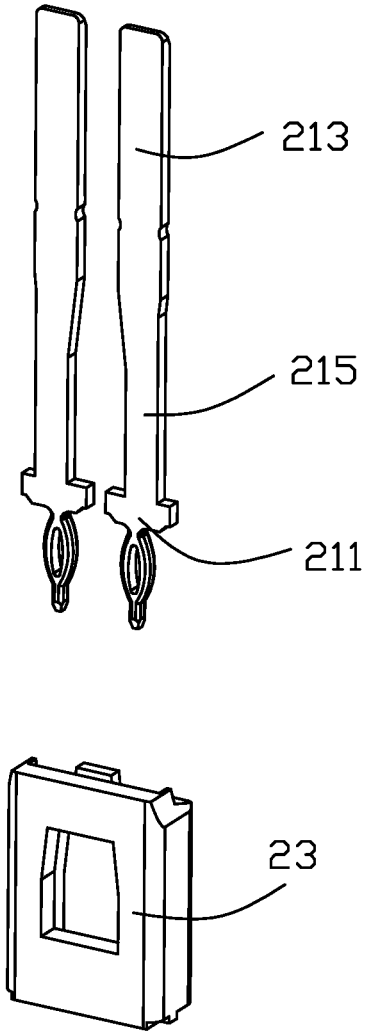
FIG. 8 is a perspective view of the terminal and the fixing block of the first electrical connector in FIG. 6.
Figure 9:
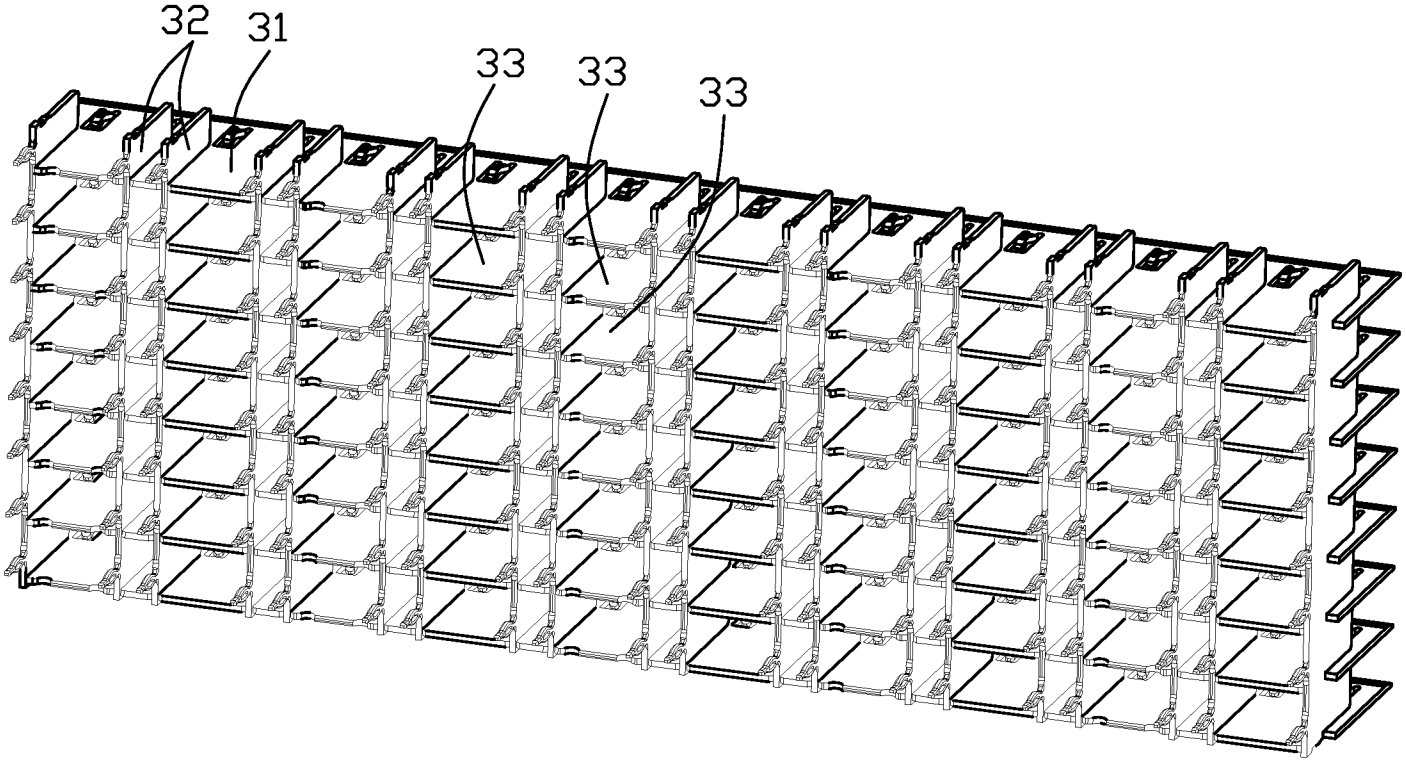
FIG. 9 is a perspective view of the first shielding sheets and the second shielding sheets of the first electrical connector in FIG. 6.
Figure 10:
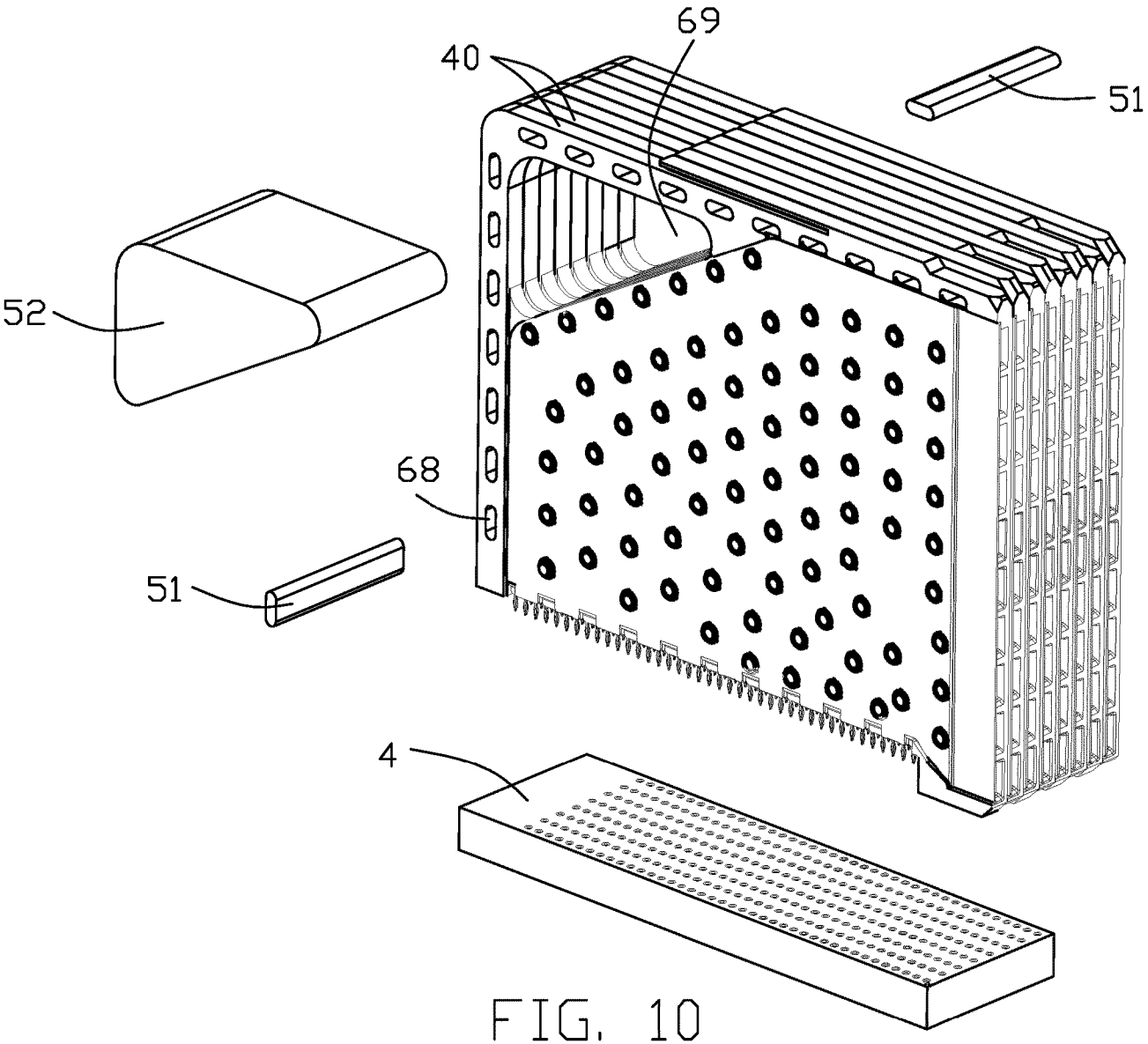
FIG. 10 is a partial exploded view of the second electrical connector in FIG. 1.
Figure 11:
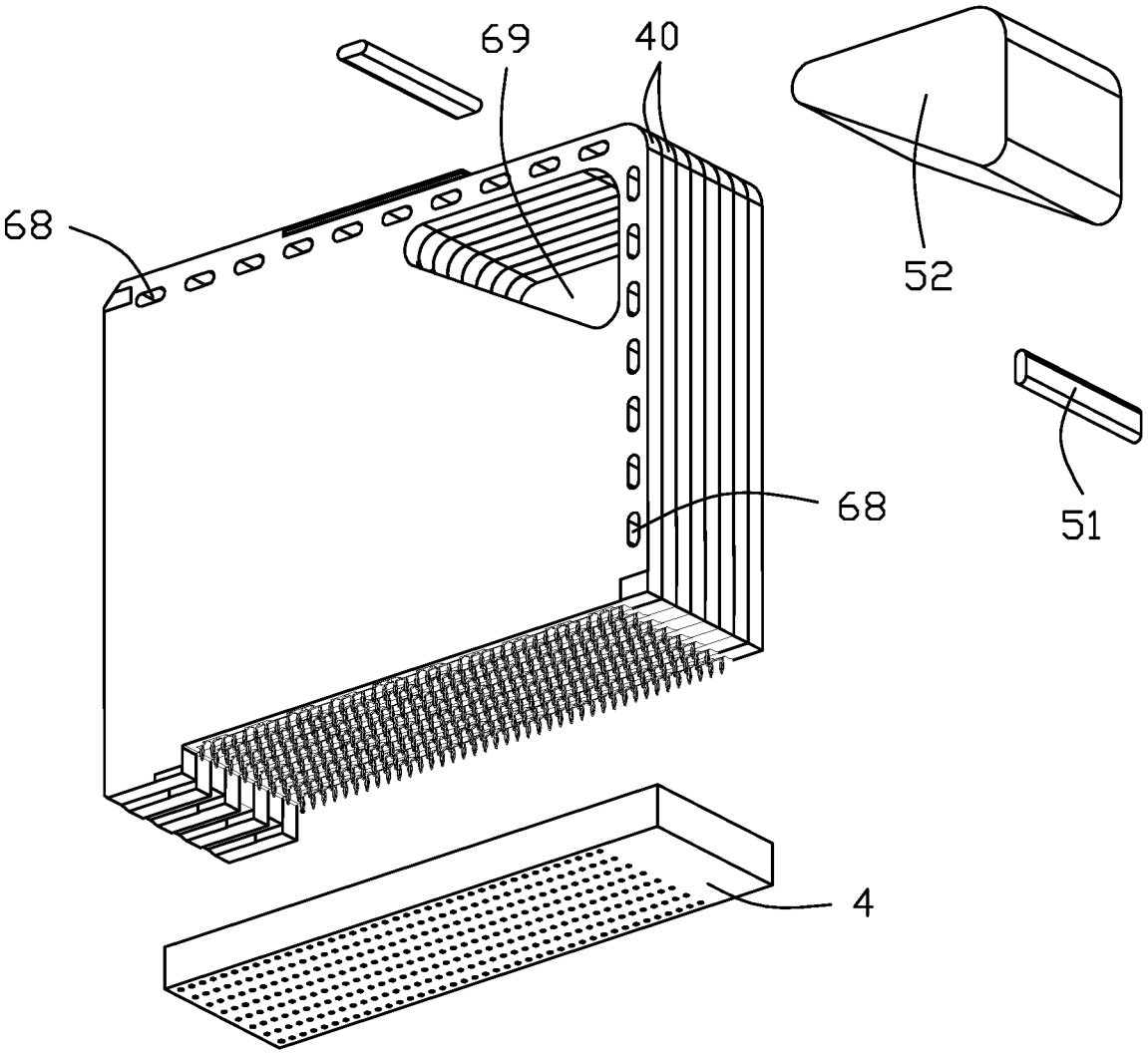
FIG. 11 is another partial exploded view of the second electrical connector in FIG. 6.
Figure 12:
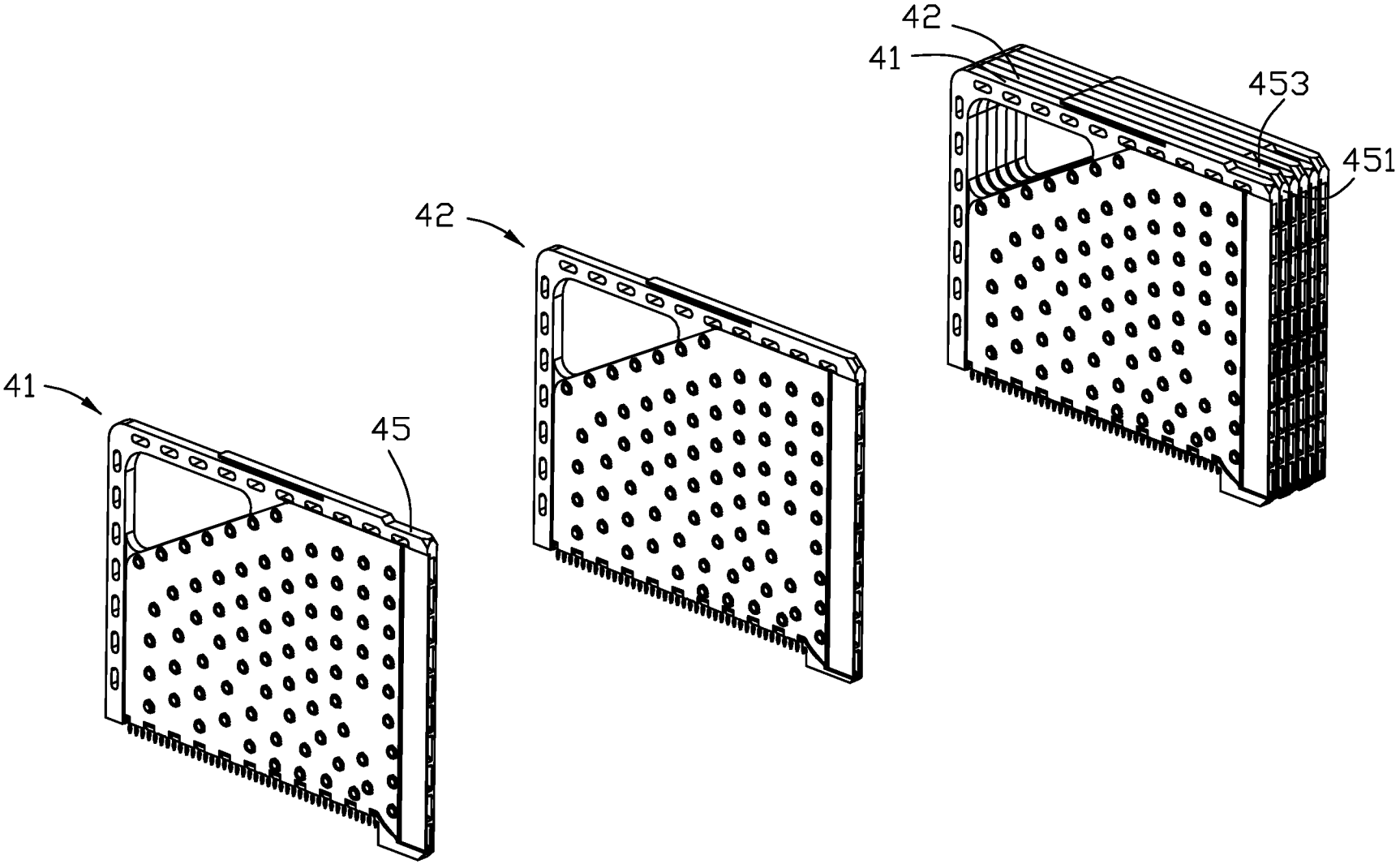
FIG. 12 is a perspective view of the modules of the second electrical connector in FIG. 10.
Figure 13:
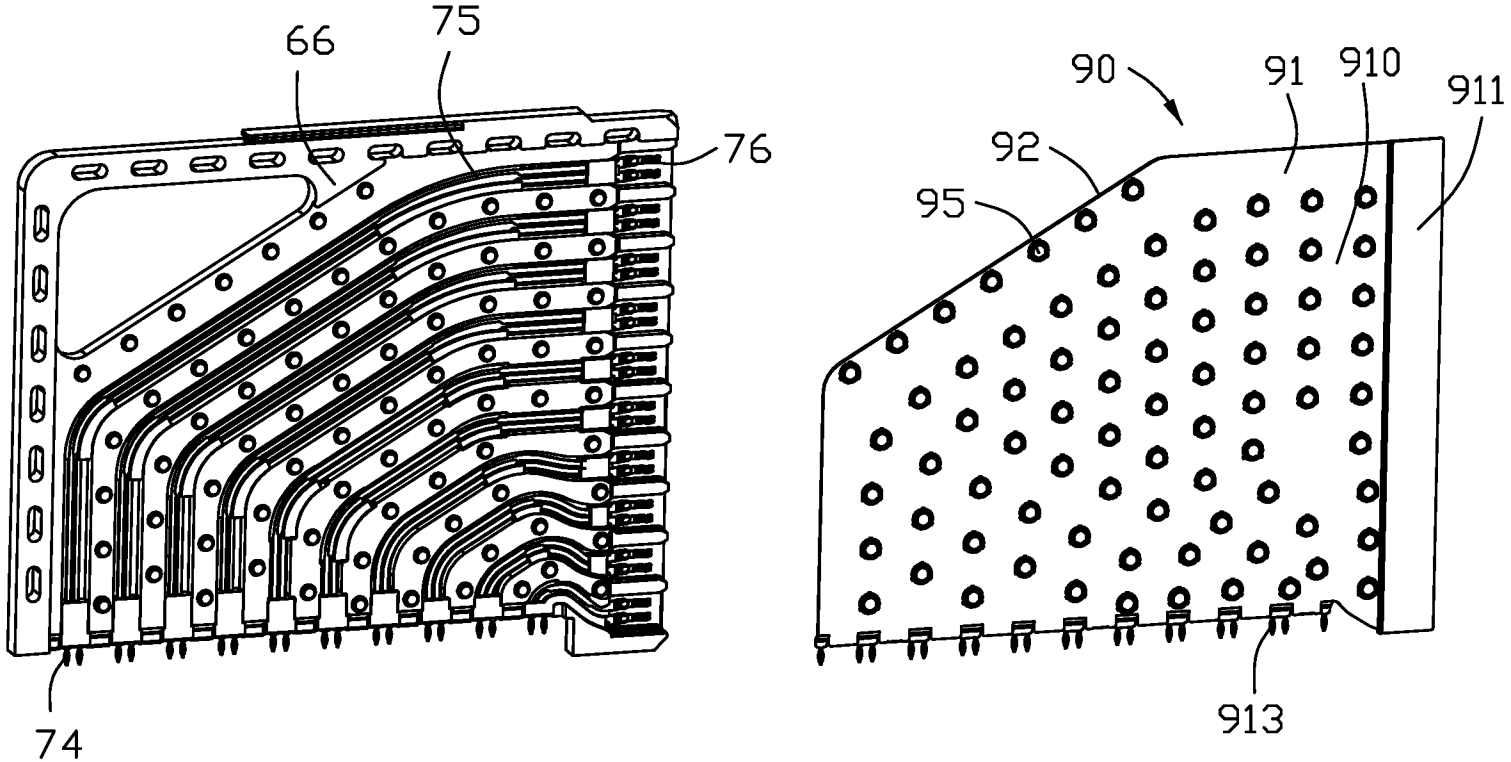
FIG. 13 is a partial exploded view of one module of the electrical connector in FIG. 12.
Figure 14:
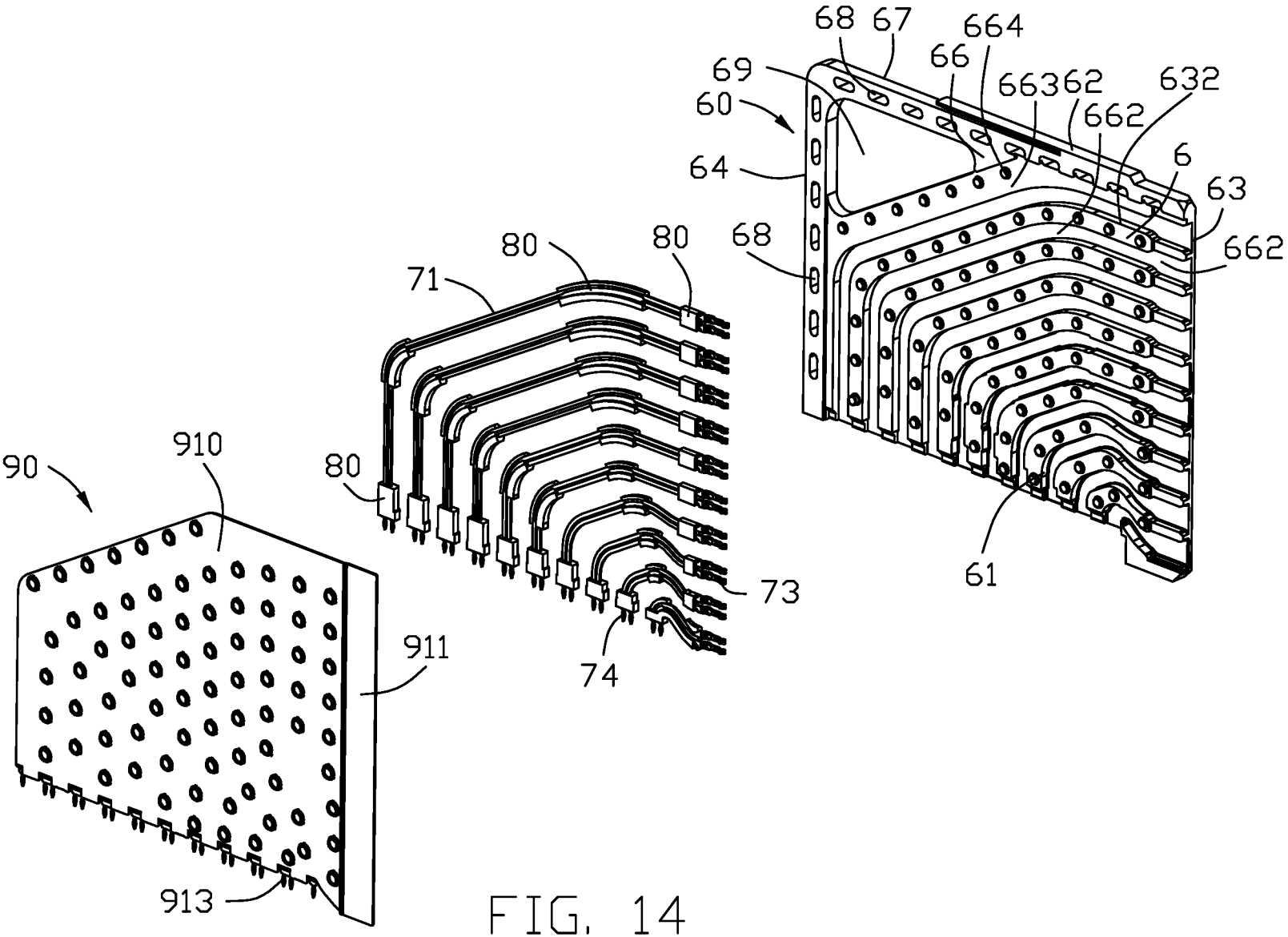
FIG. 14 is a further exploded view of one module of the electrical connector in FIG. 13.
Figure 15:
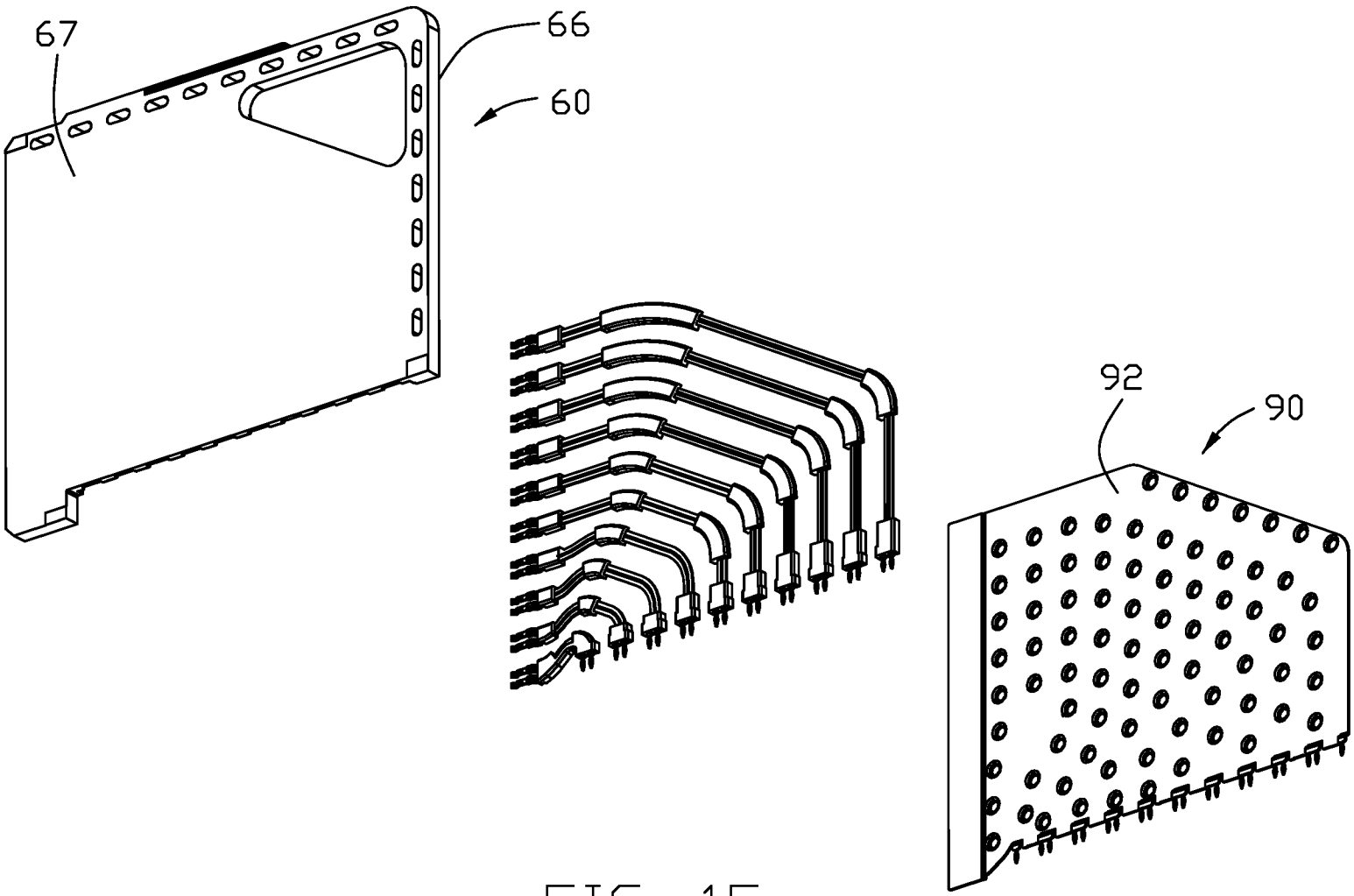
FIG. 15 is another further exploded view of one module of the electrical connector in FIG. 13.
Figure 16:
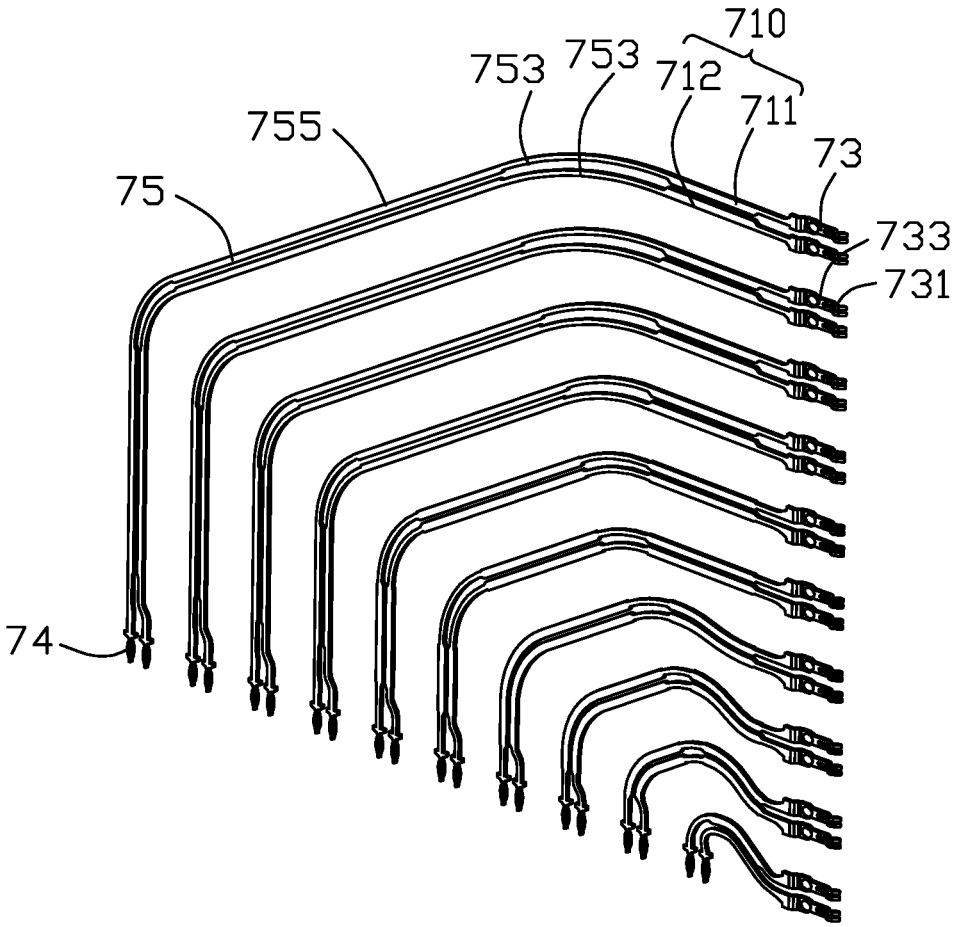
FIG. 16 is a perspective view of the signal terminals of one module in FIG. 15.
Figure 17:
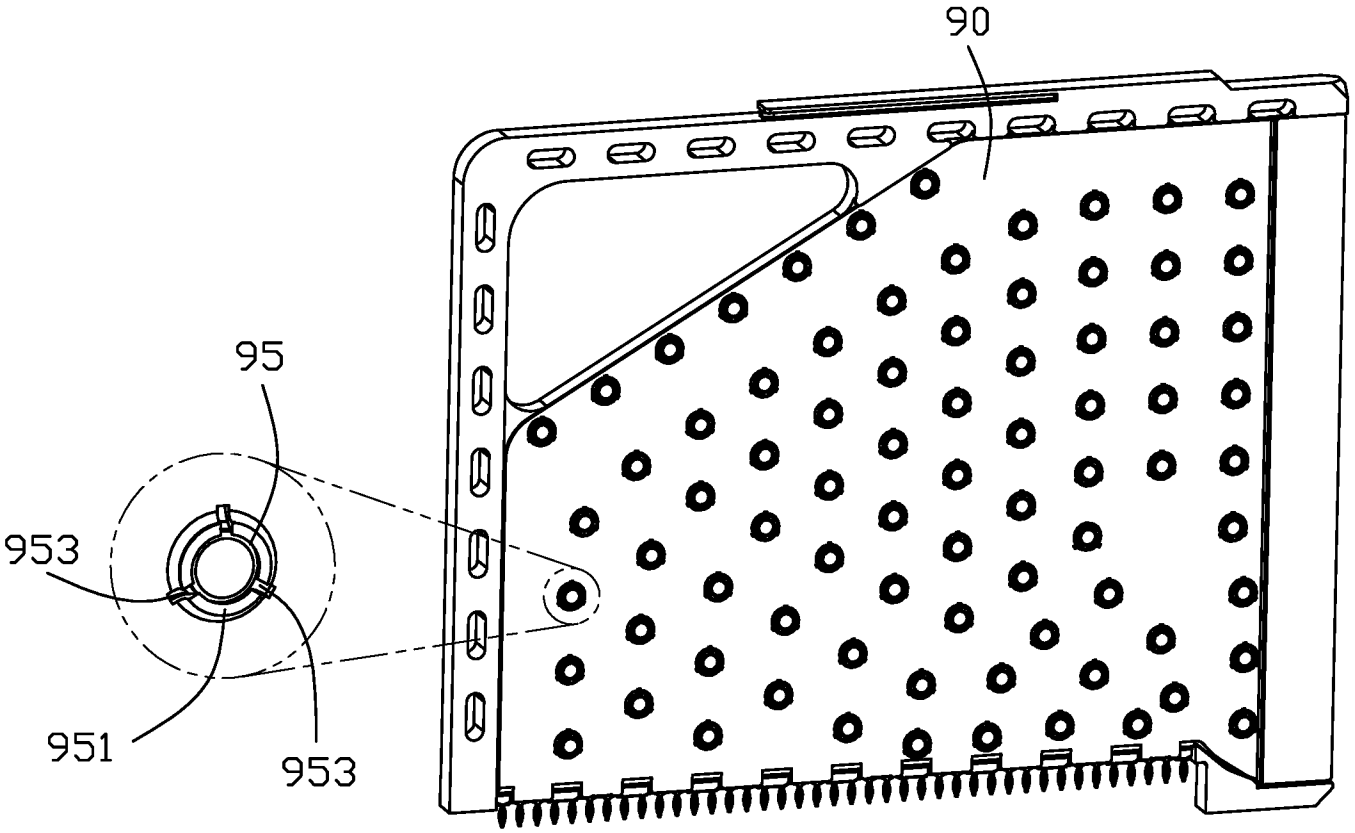
FIG. 17 is a perspective view of the grounding plate and the conductive shell of one module in FIG. 15.
Figure 18:
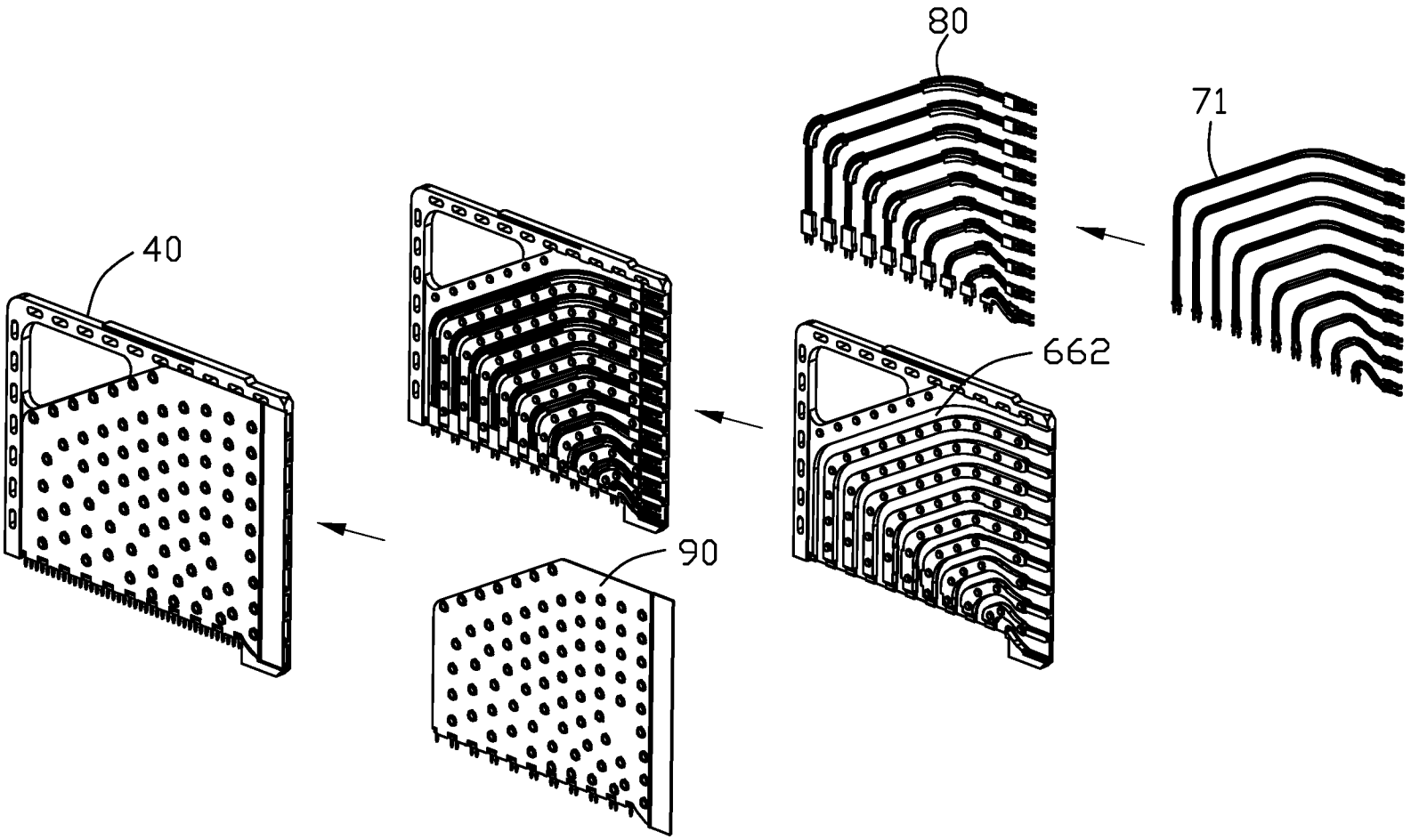
FIG. 18 is the assembly flow chart of one module in FIG. 12.
Figure 19:
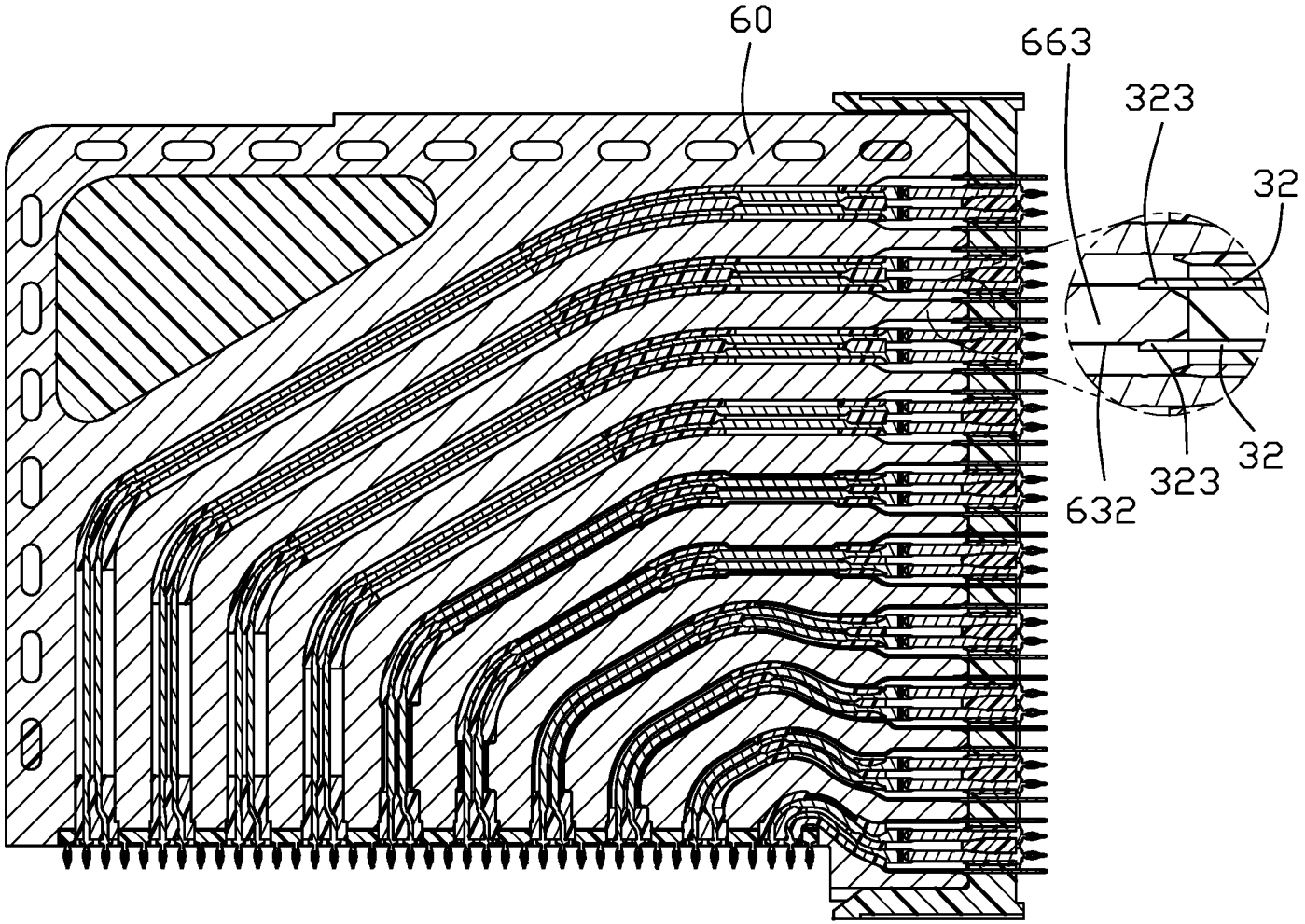
FIG. 19 is a cross-sectional view along line 19-19 of the connector assembly in FIG. 1.
Figure 20:
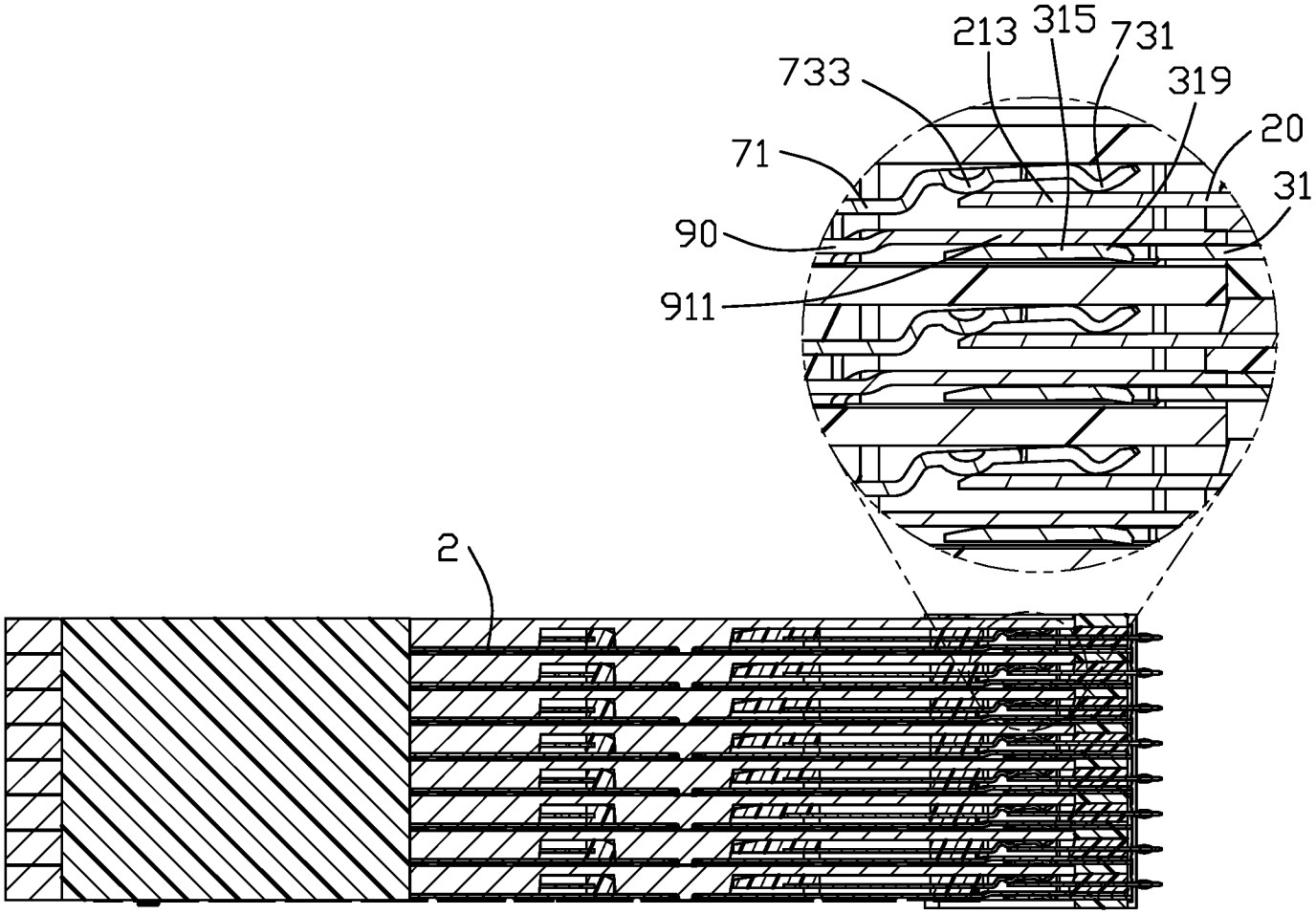
FIG. 20 is a cross-sectional view along line 20-20 of the connector assembly in FIG. 1.

Referring to FIGS. 1-20, a connector assembly 100 of the present invention is shown. The connector assembly 100 includes a first electrical connector 1 and a second electrical connector 2 that cooperates with the first electrical connector 1. The first electrical connector 1 is mounted on a first circuit board 3, and the second electrical connector 2 is mounted on a second circuit board 4. The transmission speed of each channel of the first electrical connector 1 and the second electrical connector 2 can reach 112 Gbps or higher.

The first electrical connector 1 includes a housing 10, a plurality of terminals 20 held on the housing 10, a plurality of first shielding sheets 31 arranged laterally to shield the terminals 20, and a plurality of second shielding sheets 32 arranged longitudinally to shield the terminals 20.

The housing 10 includes a bottom wall 11 and a pair of side walls 12 spaced apart from each other extending from the same side at both ends of the bottom wall 11. The bottom wall 11 and the two side walls 12 are jointly enclosed to form a receiving space 13. The bottom wall 11 includes a number of mounting holes 111 passing through the bottom wall 11, and the mounting holes 111 are arranged in rows and columns. The side wall 12 is provided with a guide protrusion 121 and a guide groove 123 that guide the second electrical connector 2 to be accurately inserted into the receiving space 13. The housing 10 can be made of pure metal material, or it can be made of plastic material and then plated to form a conductive surface, or it can be made of pure plastic material.

Two adjacent terminals 20 are arranged in the form of a terminal pair 22. Each terminal pair 22 is used to transmit a pair of differential signals. The terminals 20 are arrayed in rows and columns and mounted on the bottom wall 11 of the housing 10. Each terminal 20 includes a mounting portion 211 extending downward from the bottom wall 11 for mounting on the first circuit board 3, a mating portion 213 extending upward into the receiving space 13, and a body portion 215 between mounting portion 211 and the mating portion 213. Further includes a fixing block 23. The fixing block 23 is integrally formed on the body portion 215 of a pair of the terminals 20, the fixing block 23 cooperates with the mounting hole 111 on the bottom wall 11 to fix a pair of the terminals 20 on the bottom wall 11. Of course, if the housing 10 is made of pure plastic material, the terminal 20 can be directly mounted on the bottom wall 11 without the fixing block 23.

The plurality of the first shielding sheets 31 are parallel to each other, and the plurality of the second shielding sheets 32 are parallel to each other. The first shielding sheet 31 and the second shielding sheet 32 are arranged to cross each other. In this embodiment, the plurality of the first shielding sheets 31 and the plurality of the second shielding sheets 32 are perpendicular to each other to form a plurality of shielding cavities 33 separated from each other. Each of the terminal pairs 22 is distributed in the corresponding shielding cavity 33. In this way, a first shielding sheet 31 is provided between the two adjacent terminal pairs 22 in the transverse direction, two second shielding sheets 32 spaced apart from each other are provided between two adjacent terminal pairs 22 in the longitudinal direction. The plurality of first shielding sheets 31; the plurality of second shielding sheets 32 and the housing 10 are integrally formed by die-casting or integrally formed by powder metallurgy. It can also be that the plurality of first shielding sheets 31 and the plurality of second shielding sheets 32 are formed by integrally die-casting or formed by powder metallurgy, and then assembled on the housing 10, or the first shielding sheet 31 and the second shielding sheet 32 are respectively stamped from metal sheets and then assembled on the housing 10, the housing 10 may be formed by die-casting or powder metallurgy, or it can be formed of a plastic material by injection molding and then electroplated to form a conductive surface, it can also be formed by injection molding only of plastic material. Each of the first shielding sheets 31 includes a first mating portion 313 extending upward into the receiving space 13. The first mating portion 313 includes a flat portion 315 and a plurality of elastic sheets 319 extending from the flat portion 315. The second shielding sheet 32 includes a second mating portion 323 extending into the receiving space 13. The first mating portion 313 extending into the receiving space 13 is larger than the mating portion 213 of the terminal 20 extending into the receiving space 13. The second mating portion 323 extending into the receiving space 13 is smaller than the terminal 20 entering the receiving space 13. The second shielding sheet 32 also includes a plurality of ground pins 327 extending downward for mounting on the first circuit board 3. The first shielding sheet 31 is not provided with ground pins.

Each of the terminal pair 22 of the first electrical connector 1 of the present invention is completely shielded by the first shielding sheet 31 and the second shielding sheet 32 in the circumferential direction, which improves the shielding effect of the first electrical connector 1. Two spaced apart second shielding sheets 32 are provided between each terminal pairs 22 and its longitudinal adjacent terminal pairs 22, this has a better shielding effect and provides better conditions for the stable transmission of high-frequency signals.

The second electrical connector 2 includes a plurality of module sheets 40 stacked laterally and a fixing member 50 for fixing the plurality of module sheets 40 into a whole. Each module sheet 40 includes a conductive shell 60, a plurality of signal terminals 71 housed in the conductive shell 60 from one side of the conductive shell 60, an insulating member 80 that electrically isolates the signal terminal 71 from the conductive shell 60, and a sheet-shaped ground plate 90 installed on one side of the conductive shell 60.

The conductive shell 60 has good conductivity and heat dissipation. The conductive shell 60 may be formed by die-casting, powder metallurgy, injection molding and then electroplating a conductive surface, or formed by other processes. The conductive shell 60 includes a lower edge 61 disposed toward the second circuit board 4, an upper edge 62 opposite to the lower edge 61, a front edge 63 opposite to the first electrical connector 1 and a rear edge 64 opposite to the front edge 63.

The conductive shell 60 is a sheet-like structure. The thickness direction of the conductive shell 60 is the transverse direction. It has a first side surface 66 and a second side surface 67 opposed to each other in the thickness direction. The first side surface 66 is provided with a plurality of grooves 662. Each of the grooves 662 is recessed from the first side surface 66 toward the conductive shell 60 and extends from the front edge 63 to the lower edge 61. The groove 662 is used to receive the signal terminal 71. The insulating member 80 has the same contour shape as that of the groove 662 for being received in the groove 662. The two sides of each groove 662 form opposite ribs 663. The rib 663 includes a surface 660 located on the first side surface 66 and a side surface 632 located in the groove 662. The side surface 632 near the front edge 63 of is mechanically and electrically connected to the second mating portion 323 of the second shielding sheet 32 of the first electrical connector 1. A plurality of convex hulls 664 are provided on the surface 660 of the rib 663. The convex hull 664 and the conductive shell 60 are formed by integral die-casting or they may be formed by coating a layer of conductive material after injection molding. The convex hull 664 is cylindrical or square or other shapes, and the convex hull 664 is preferably cylindrical in this embodiment. The area between the outermost rib 663 and the upper edge 62 and the rear edge 64 is provided with a plurality of first holes 68 penetrating the conductive shell 60 transversely and a second hole 69 having a different shape from the first hole 68. The plurality of the first holes 68 are arranged close to the upper edge 62 and the rear edge 64, and are arranged along a first direction and a second direction perpendicular to each other. The second hole 69 is arranged near the junction of the upper edge 62 and the rear edge 64, and is located on the inward side of the plurality of first holes 68, The first hole 68 is elongated, and the length of the first hole 68 in the first direction is arranged along the first direction, and the length of the first hole 68 in the second direction is arranged along the second direction. The second hole 69 is roughly triangular with rounded corners at three corners. The size of the second hole 69 is greater than the sum of the sizes of all the first holes 68. The first holes 68 of each of the module sheets 40 are aligned with each other, and the second holes of each of the module sheets 40 are aligned with each other. The fixing member 50 includes a plurality of first pins 51 passing through a corresponding plurality of the first holes 68, and a second pin 52 passing through the second hole 69. The cross-sectional of the first pin 51 is the same as the shape of the first hole 68, and the cross-sectional of the second pin 52 is the same as the shape of the second hole 69. The material of the first pin 51 and the second pin 52 may be metal or plastic material. The first pin 51 and the second pin 52 fix the module sheets 40 together, so that the mutual alignment accuracy of the module sheets 40 is high, and the structure is simple and easy to implement, in addition, no additional structure is added to the module sheet 40, so the volume of the second electrical connector 2 is not increased, which makes the second electrical connector 2 of the present invention more compact. The first side surface 66 of the conductive shell 60 is recessed inward to a depth for mounting the ground plate 90, and the thickness of the ground plate 90 is not greater than the depth of the recess.

The signal terminal 71 is arranged in the form of a signal terminal pair 710 for transmitting a pair of differential signals. Each signal terminal pair 710 is received in a corresponding groove 662 on the conductive shell 60. Each of the signal terminals 71 includes a mating end 73 that matches with the first electrical connector 1, a mounting foot 74 that can be mounted on the second circuit board 4, and an intermediate portion 75 between the mounting foot 74 and the mating end 73. The mating end 73 is perpendicular to the mounting foot 74. The mounting foot 74 extend out of the conductive shell 60 in the mounting direction, and the intermediate portion 75 and the mating end 73 are received in the groove 662, and the mating end 73 does not extend beyond the front edge 63 of the conductive shell 60 in the mating direction. The insulating member 80 is arranged on the intermediate portion 75 of the signal terminal 71 so that the signal terminal 71 does not directly contact the conductive shell 60. The insulating member 80 is integrally formed on the intermediate portion 75 of the signal terminal pair 710, and of course it can be assembled in the intermediate portion 75. The insulating member 80 on most of the signal terminal 71 is discretely arranged in the length direction of the signal terminal 71. That is, the insulating member 80 is disconnected in the length direction of the signal terminal 71. The portion of the signal terminal 71 that is not held in the insulating member 80 is suspended in the groove 662 and exposed to the air. The length of the signal terminal 71 exposed to the air is greater than the length covered in the insulating member 80. The intermediate portion 75 includes a first portion 753 that is held in the insulating member 80 and a second portion 755 that is exposed to the air. The width dimension of the first portion t 753 is smaller than the width dimension of the second portion 755. The two signal terminals 71 of the signal terminal pair 710 are edge-to-edge coupled. The two opposite narrow sides of the first portion 753 of the signal terminal pair 710 are recessed to each other. The signal terminal pair 710 includes a first signal terminal 711 and a second signal terminal 712, and the length of the first signal terminal 711 is greater than the length of the second signal terminal 712 on the signal transmission path. The length of the first signal terminal 711 exposed to the air is greater than the length of the second signal terminal 712 exposed to the air. In particular, the first portion 753 of the first signal terminal 711 held in the insulating member 80 can be exposed to the air from one side, and the first portion 753 of the second signal terminal 712 held in the insulating member 80 is not exposed to the air. Each mating end 73 includes a front contact point 731 and a rear contact point 733 arranged along the mating direction. When mated with the first electrical connector 1, the front contact point 731 and the rear contact point 733 have two contact points along the mating direction with the terminal 20 of the first electrical connector 1. Compared with one contact point, the front and back two contact points effectively solve the impact of capacitance effect on impedance matching during high-speed signal transmission, improved impedance matching after interconnection and improved insertion loss.

The ground plate 90 is disposed on the first side surface 66 of the conductive shell 60. The ground plate 90 includes a first side 91 and a second side 92 opposite to the first side 91. The second side 92 of the ground plate 90 and the first side surface 66 of the conductive shell 60 cooperate with each other. The ground plate 90 is provided with a plurality of holes 95 that penetrate the first side 91 and the second side 92 transversely. The holes 95 cooperate with the convex hulls 664 on the conductive shell 60. The holes 95 is stamped from the second side 92 to the first side 91 and forms a tear surface 951. The tear surface 951 faces the first side 91. The hole is flared and the size of the second side 92 is larger than the size of the first side 91. Each of the holes 95 is provided with a plurality of circumferentially distributed slits 953, during the process of mating with the convex hull 664, the hole 95 can expanded to closely fit with the convex hull 664. The holes 95 cooperate with the convex hulls 664 on the ribs 663 on the conductive shell 60, so that the ground plate 90 and the conductive shell 60 are in contact at multiple points, which effectively reduces the crosstalk problem in the loop and increase the shielding effect. The ground plate 90 includes a plate portion 910, a contact portion 911 extending from the flat plate portion 910 in the mating direction, a plurality of eye-of-needle pins 913 extending from the plate portion 910 in the mounting direction that can be mounted on the second circuit board 4. The pin 913 and the mounting foot 74 of the signal terminal 71 are located in the same plane, and the pin 913 is arranged between the mounting foot 74 of the adjacent signal terminal pair 710. The pins 913 are integrally stamped out from the ground plate 90, and then bent from the plane where the ground plate 90 is located to the plane where the signal terminal 71 is located. The front end of the contact portion 911 is aligned with the front end of the conductive shell 60. The contact portion 911 is closer to the conductive shell 60 than the plate portion 910. When the module sheets 40 are assembled together, there is a certain distance between the contact portion 911 of one module sheet 40 and the conductive shell 60 of the adjacent module sheets 40, so that the first mating portion 313 of the first shielding sheet 31 of the first electrical connector 1 can extend into two adjacent module sheets 40, the flat portion 315 of the first mating portion 313 is in contact with the conductive shell 60, and the elastic sheets 319 and the contact portion 911 are in contact with each other. The conductive shell 60 and the ground plate 90 cooperate with each other so that each of the grooves 662 respectively form a circumferentially closed shielded channel, The shielded channel surrounds a pair of signal terminals 71 located in the channel from the circumferential direction on the entire transmission path, shielding in all directions, this makes the crosstalk between the signal terminal pairs 710 be reduced to the most ideal state to transmit higher rate signals.

The module sheets 40 includes a first type of module piece 41 and a second type of module piece 42 arranged at intervals from the first type of module piece 41. The upper edge 62 and the lower edge 61 of the conductive shell 60 of one of the first type of module piece 41 and the second type of module piece 42 are provided with a recess 45 near the front edge 63. When the first type of module piece 41 and the second type of module piece 42 are assembled together, opposite mounting grooves 451 and protrusions 453 are formed. The mounting groove 451 and the protrusion 453 cooperate with the guide protrusion 121 and the guide groove 123 of the first electrical connector 1 to form a guide matching mechanism. When assembling the module sheets 40, first fix the signal terminal 71 in the insulating member 80, then assemble the fixed signal terminal 71 in a corresponding groove 662 on the conductive shell 60, Finally, install the ground plate 90 on one side of the conductive shell 60 to shield the signal terminal 71 in the groove 662.

After the first electrical connector 1 and the second electrical connector 2 are mated, each pair of terminals 20 and the corresponding signal terminal pair 710 cooperate with each other to form a pair of signal paths. The first shielding sheet 31 can be mechanically and electrically connected to the ground plate 90 and the conductive shell 60 on the adjacent sides of the two adjacent module sheets 40. The second shielding sheet 32 and the ribs 663 on the conductive shell 60 cooperate with each other to completely shield the terminals 20 and the signal terminals 71 of the pair of signal paths on the transmission path, which has a good effect of shielding electromagnetic crosstalk and reliable and provides better conditions for stable transmission of high-frequency signals, and the structure is simple.

What is claimed is:

1. An electrical connector comprising:

a plurality of module sheets stacked laterally, each module sheet including:

a conductive shell having a plurality of grooves on one side thereof and a plurality of ribs each formed between every two adjacent grooves;

a plurality of signal terminals accommodated in corresponding grooves;

a plurality of insulating members which are installed in the conductive shell for fixing corresponding signal terminals and electrically isolating the signal terminals from the conductive shell; and a sheet-shaped ground plate installed on the one side of the conductive shell; and a fixing member for securing the plurality of module sheets together; wherein the insulating members on at least one of the signal terminals are discretely arranged; and each of the module sheets is provided with a plurality of first holes penetrating the conductive shell transversely and a second hole with a shape different from the first hole, and the fixing member includes a plurality of first pins passing through the first holes and a second pin passing through the second hole.

2. The electrical connector as claimed in claim 1, wherein the ribs are provided with a plurality of convex hulls, the ground plate is provided with a plurality of holes matching with the convex hulls, the convex hull is cylindrical, and the convex hulls and the conductive shell are integrally formed by die-casting.

3. The electrical connector as claimed in claim 2, wherein the sheet-shaped ground plate includes a first side and a second side opposite to the first side, the second side is matched with the conductive shell, each of the holes is stamped from the second side to the first side, and a tearing surface formed by stamping on the hole faces the second side.

4. The electrical connector as claimed in claim 3, wherein the hole is flared so that a size thereof on the second side is larger than a size thereof on the first side, the hole is provided with a plurality of slits evenly distributed in a circumferential direction, and the hole is stretched to fit tightly with the convex hull.

5. The electrical connector as claimed in claim 1, wherein the signal terminals are arranged in the form of signal terminal pairs for transmitting differential signals, each of the signal terminals includes a mounting foot, and the ground plate includes a plurality of mounting pins, the mounting pins and the mounting feet are located in a common plane, and the pins are arranged between the mounting feet of adjacent signal terminal pairs.

6. The electrical connector as claimed in claim 1, wherein the module sheet includes a lower edge facing a mounting direction and an upper edge opposite to the lower edge, a front edge facing a mating direction, and a rear edge opposite to the front edge, the plurality of module sheets includes alternating first type of module pieces and second type of module pieces, and the upper edge and the lower edge near the front edge of one type of the first type of module piece and the second type of module piece are recessed toward the conductive shell so that when the first type of module piece and the second type of module piece are assembled together opposing mounting grooves and protrusions are formed.

7. The electrical connector as claimed in claim 1, wherein a portion of the signal terminal not covered by the insulating member is suspended in the groove and exposed to air, and the length of the signal terminal exposed to air is greater than the length covered by the insulating member.

8. The electrical connector as claimed in claim 7, wherein a width dimension of the signal terminal covered in the insulating member is smaller than a width dimension of the signal terminal exposed to air.

9. The electrical connector as claimed in claim 8, wherein the signal terminals are arranged in the form of a signal terminal pair for transmitting differential signals, the two signal terminals forming the signal terminal pair are housed in same groove, each of the signal terminals includes a mounting foot mounted on a circuit board, a mating end, and an intermediate portion between the mating end and the mounting foot, the mounting foot extends out of the conductive shell in the mounting direction, and the intermediate portion and the mating end are received in the groove.

10. The electrical connector as claimed in claim 9, wherein each of the signal terminal pair includes a first signal terminal and a second signal terminal, a length of the first signal terminal is greater than a length of the second signal terminal, the length of the first signal terminal exposed to air is larger than the length of the second signal terminal exposed to air.

11. The electrical connector as claimed in claim 1, wherein the plurality of first holes are arranged along a first direction and a second direction perpendicular to each other.

12. The electrical connector as claimed in claim 11, wherein the conductive shell includes a lower edge toward the mounting direction, an upper edge opposite to the lower edge, a front edge facing the mating direction, and a rear edge opposite to the front edge, the conductive shell is provided with a plurality of grooves extending from the front edge to the lower edge for accommodating corresponding signal terminals, the first hole and the second hole are provided in an area between an outermost groove and the upper and rear edges of the conductive shell.

13. The electrical connector as claimed in claim 12, wherein the plurality of first holes are arranged near the upper edge and the rear edge, the second hole is arranged near a junction of the upper edge and the rear edge and is on an inner side of the plurality of first holes.

14. The electrical connector as claimed in claim 13, wherein the first hole is elongated, the second hole is triangular, and a size of the second hole is greater than a sizes of all the first holes.

15. An electrical connector comprising:

a plurality of module sheets stacked laterally, each module sheet including:

a conductive shell having a plurality of grooves on one side thereof and a plurality of ribs each formed between every two adjacent grooves;

a plurality of signal terminals accommodated in corresponding grooves;

a plurality of insulating members which are installed in the conductive shell for fixing corresponding signal terminals and electrically isolating the signal terminals from the conductive shell; and a sheet-shaped ground plate installed on the one side of the conductive shell; and a fixing member for securing the plurality of module sheets together; wherein the insulating members on at least one of the signal terminals are discretely arranged;

the ribs are provided with a plurality of convex hulls, the ground plate is provided with a plurality of holes matching with the convex hulls, the convex hull is cylindrical, and the convex hulls and the conductive shell are integrally formed by die-casting; and the sheet-shaped ground plate includes a first side and a second side opposite to the first side, the second side is matched with the conductive shell, each of the holes is stamped from the second side to the first side, a tearing surface formed by stamping on the hole faces the second side.

16. The electrical connector as claimed in claim 15, wherein the hole is flared so that a size thereof on the second side is larger than a size thereof on the first side, the hole is provided with a plurality of slits evenly distributed in a circumferential direction, and the convex hull fits tightly with the hole.

17. An electrical connector comprising:

a plurality of module sheets stacked laterally, each module sheet including:

a conductive shell having a plurality of grooves on one side thereof and a plurality of ribs each formed between every two adjacent grooves;

a plurality of signal terminals accommodated in corresponding grooves;

a plurality of insulating members which are installed in the conductive shell for fixing corresponding signal terminals and electrically isolating the signal terminals from the conductive shell; and a sheet-shaped ground plate installed on the one side of the conductive shell; and a fixing member for securing the plurality of module sheets together; wherein the insulating members on at least one of the signal terminals are discretely arranged; and the module sheet includes a lower edge facing a mounting direction and an upper edge opposite to the lower edge, a front edge facing a mating direction, and a rear edge opposite to the front edge, the plurality of module sheets include alternating first type of module pieces and second type of module pieces, and the upper edge and the lower edge near the front edge of one type of the first type of module piece and the second type of module piece are recessed toward the conductive shell so that when the first type of module piece and the second type of module piece are assembled together opposing mounting grooves and protrusions are formed.

18. An electrical connector comprising:

a plurality of module sheets stacked laterally, each module sheet including:

a conductive shell having a plurality of grooves on one side thereof and a plurality of ribs each formed between every two adjacent grooves;

a plurality of signal terminals accommodated in corresponding grooves;

a plurality of insulating members which are installed in the conductive shell for fixing corresponding signal terminals and electrically isolating the signal terminals from the conductive shell; and a sheet-shaped ground plate installed on the one side of the conductive shell; and a fixing member for securing the plurality of module sheets together; wherein the insulating members on at least one of the signal terminals are discretely arranged;

a portion of the signal terminal not covered by the insulating member is suspended in the groove and exposed to air, and the length of the signal terminal exposed to air is greater than the length covered by the insulating member;

a width dimension of the signal terminal covered in the insulating member is smaller than a width dimension of the signal terminal exposed to air;

the signal terminals are arranged in the form of a signal terminal pair for transmitting differential signals, the two signal terminals forming the signal terminal pair are housed in same groove, each of the signal terminals includes a mounting foot mounted on a circuit board, a mating end, and an intermediate portion between the mating end and the mounting foot, the mounting foot extends out of the conductive shell in the mounting direction, and the intermediate portion and the mating end are received in the groove; and each of the signal terminal pair includes a first signal terminal and a second signal terminal, a length of the first signal terminal is greater than a length of the second signal terminal, the length of the first signal terminal exposed to air is larger than the length of the second signal terminal exposed to air.

* * * * *